US007695376B2

(12) United States Patent
Kaczmarz et al.

(10) Patent No.: US 7,695,376 B2
(45) **Date of Patent: *Apr. 13, 2010**

(54) GOLF CLUB MOVEABLE DISC SHAFT ANGLE ADJUSTMENT TECHNOLOGY

(76) Inventors: Gregory Andrew Kaczmarz, 3 Savile Ave., Winnipeg, Manitoba (CA) R3R 2T4; Bruce M Kisell, 139 Novara Drive, Winnipeg, Manitoba (CA) R2P 2X9; Johanna P Lalman, 139 Novara Drive, Winnipeg, Manitoba (CA) R2P 2X9; Tracy R Young, 6 Walter Copp Crescent, Winnipeg, Manitoba (CA) R2K 4H6; Mike J. Bartmanovich, 129 Stoney Lake Bay, Winnipeg, Manitoba (CA) R3W 1L1

( * ) Notice: Subject to any disclaimer, the term of this patent is extended or adjusted under 35 U.S.C. 154(b) by 0 days.

This patent is subject to a terminal disclaimer.

(21) Appl. No.: 12/222,316

(22) Filed: Aug. 7, 2008

(65) Prior Publication Data

US 2010/0035697 A1 Feb. 11, 2010

(51) Int. Cl.
*A63B 53/02* (2006.01)
*A63B 53/06* (2006.01)

(52) U.S. Cl. ..... 473/244; 473/248; 473/313; 473/251; 473/340; 473/342

(58) Field of Classification Search ..... 473/244–248, 473/305–315, 251, 340, 342
See application file for complete search history.

(56) References Cited

U.S. PATENT DOCUMENTS

| | | | | | |
|---|---|---|---|---|---|
| 2,661,952 | A * | 12/1953 | Jackson | ..... | 473/248 |
| 4,735,414 | A * | 4/1988 | Williams et al. | ..... | 473/248 |
| 4,815,740 | A * | 3/1989 | Williams et al. | ..... | 473/248 |
| 5,716,287 | A * | 2/1998 | Levocz et al. | ..... | 473/248 |
| 5,863,257 | A * | 1/1999 | Busnardo | ..... | 473/246 |
| 6,120,384 | A * | 9/2000 | Drake | ..... | 473/248 |
| 6,142,884 | A * | 11/2000 | Yim | ..... | 473/248 |
| 6,171,203 | B1 * | 1/2001 | Huang | ..... | 473/305 |
| 6,527,649 | B1 * | 3/2003 | Neher et al. | ..... | 473/248 |

* cited by examiner

*Primary Examiner*—Sebastiano Passaniti

(57) ABSTRACT

Technology that allows the angle of the shaft of a golf club to adjust in small increments. The front of the club head consists of a round opening that accepts a corresponding thin round member which can be rotated to a number of positions. The round opening also accepts a corresponding round member on the end of the shaft. This round member slides into the round opening in the front of the club head after the thin round member is seated firmly. A protrusion on the round shaft member will insert into one of the many divots on the opposing face of the thin round member, resulting in an allowable shaft angle.

1 Claim, 2 Drawing Sheets

GOLF CLUB MOVEABLE DISC SHAFT ANGLE ADJUSTMENT TECHNOLOGY

BACKGROUND OF THE INVENTION

This invention relates to the field of golf, specifically technology that allows the angle of the shaft of a golf club (ie. the lie) to easily adjust in small increments. A golf club shaft is typically fixed to the head and cannot be adjusted in such a way as to change the lie. This fixed angle is not always the best position for a golfer addressing the ball due to the golfer's size, stature, and/or style of play. This invention was conceived when a method was sought to not only allow the shaft angle to adjust in small increments and prevent movement at the point where the shaft connects to the club head when tightened, but also eliminate the use of small, difficult-to-handle parts such as a ball bearing. This invention improves on the technology described in my prior patent submission, application Ser. No. 12/081,697, which itself improved on the technology described in my other patent, U.S. Pat. No. 6,527,649.

BRIEF SUMMARY OF THE INVENTION

A golf club moveable disc shaft angle adjustment technology is described that allows the angle of the shaft of a golf club (ie. the lie) to easily adjust in small increments, prevents movement as is the case with gears or teeth, and eliminates the use of small, difficult-to-handle parts such as a ball bearing.

The front of the club head consists of a round opening that accepts a corresponding thin round member. The face of the club inside the round opening on the club head consists of a series of divots. The face of the thin round member that opposes the face of the club inside the round opening on the club head has protrusions. The protrusions and divots allow the thin round member to be seated firmly in one of a number of allowable positions.

The face of the thin round member that faces away from the club head consists of a series of divots, each of which corresponds to a unique shaft angle when the thin round member is in a particular allowable position.

The round opening on the front of the club head also accepts a corresponding round member on the end of the shaft (also called "round shaft member"). This round member on the end of the shaft slides into the round opening on the front of the club head after the thin round member is seated firmly in one of the allowable positions.

The face of the round shaft member that opposes the face of the thin round member has a protrusion. The protrusion will insert into one of the divots on the face of the thin round member, resulting in an allowable shaft angle.

Inside the club head round opening is a smaller round opening that extends through the back of the club head. The round member on the end of the shaft has an attached threaded post that inserts through the thin round member and into the smaller round opening of the club head. This allows for the tightening of both the round shaft member and the thin round member to the club head from the back of the club head with a nut.

Moving the thin round member to one of the allowable positions and inserting the round shaft member protrusion into one of the divots on the face of the thin round member will cause the shaft angle to change. The technology will allow the user to adjust the angle of the shaft in fine increments, prevent undesirable movement between the attaching parts, and eliminate the use of small, difficult-to-handle parts such as a ball bearing.

DETAILED DESCRIPTION OF THE INVENTION

Figure 1:
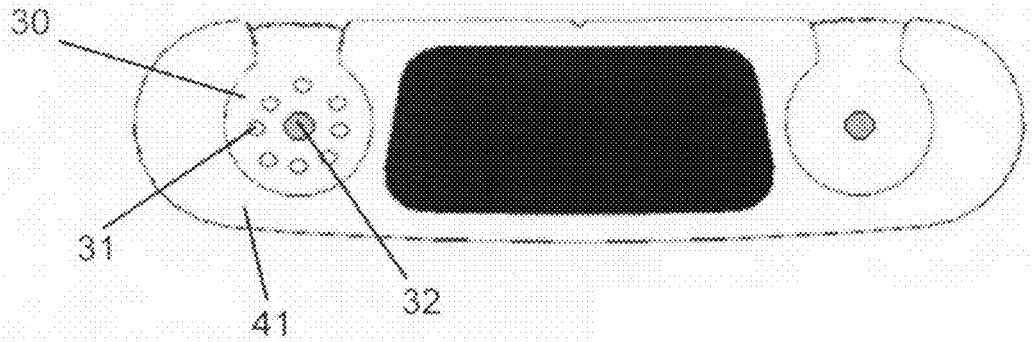
FIG. 1 is a front view of the round opening in the face of the club head, showing the divots and smaller opening through to the back of the club head for the threaded post of the attaching round shaft member.

FIG. 1 shows a front view of the round opening in the front face of the club, showing the divots and smaller opening through to the back of the club head for the threaded post of the attaching round shaft member.

Referring to FIG. 1, golf club moveable disc shaft angle adjustment technology includes a round opening 30 in the front face of the club head 41, series of divots 31, and a smaller opening 32 through to the back of the club head for the threaded post of the attaching round shaft member.

Figure 2:
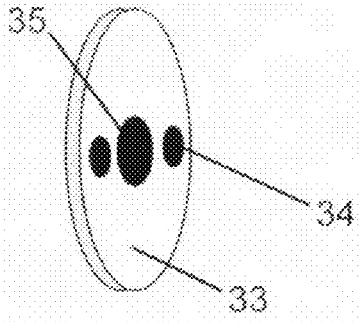
FIG. 2 is a front-side view of the thin round member surface that opposes the face of the club head and inserts into the round opening in the face of the club head.

FIG. 2 is a front-side view of the thin round member 33 surface that opposes the face of the club head, contains protrusions 34, inserts into the round opening of the club head, and has an opening 35 in the center to allow the threaded post to insert through.

Figure 3:
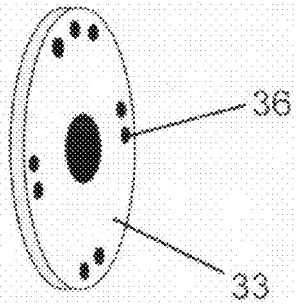
FIG. 3 is a back-side view of the thin round member surface that faces away from the club head.

FIG. 3 is a back-side view of the thin round member 33 surface that faces away from the club head, and contains a series of divots 36.

Figure 4:
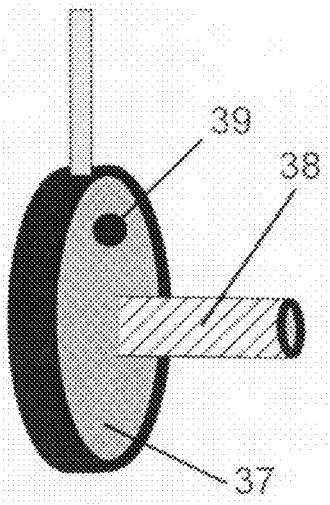
FIG. 4 is a front-side view of the round shaft member showing the threaded post and protrusion.

FIG. 4 is a front-side view of the round shaft member 37 showing the threaded post 38 and protrusion 39.

Figure 5:
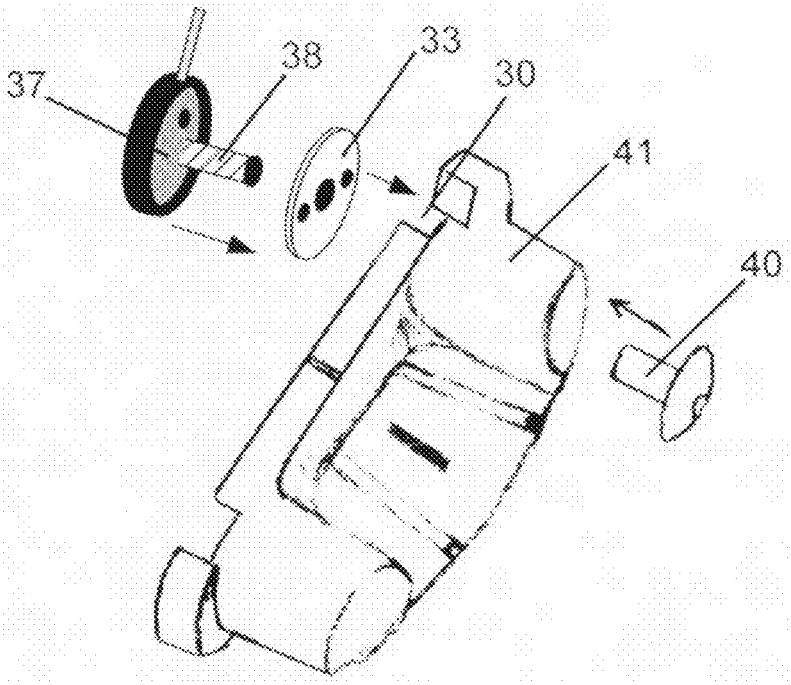
FIG. 5 is an exploded isometric view of the present invention.

FIG. 5 is an exploded isometric view of the present invention. The thin round member 33 fits into the round opening 30 in the face of the club head 41 (the divots in the round hole in the face of the club are hidden from view). The round shaft member 37 fits into the round opening 30 in the face of the club head after the thin round member 33 (the divots in the face of the thin round member that oppose the round shaft member are hidden from view). The threaded post 38 fits into the smaller opening (hidden from view) through the back of the club head and accepts a nut 40. The round shaft member, thin round member, and the club head are tightened together using the threaded post 38 and the nut 40.

The technology will allow the user to adjust the angle of the shaft in fine increments, the divots and protrusions will prevent undesirable movement between the attaching parts, and the lack of small, difficult-to-handle parts such as a ball bearing makes for easy adjustment. The combination of these features provides the golfer with the unique ability to easily adjust the golf club to suit the golfer's size, stature, and style of play.

The invention claimed is:

1. A golf club moveable disc shaft angle technology assembly comprising:

a shaft;

a club head having a face arranged for striking a golf ball and a back arranged opposite the face of the club head;

said shaft having, at one end, a round member with a face that opposes the face of the club head when the shaft is attached to the club head;

a thin round member having a hole in its center; said thin round member having two surfaces, with one surface opposing the round shaft member and the other opposing the face of the club head when the shaft and thin round member are attached to the club head;

a round opening in the face of the club head for receiving both the thin round member and the round shaft member;

a smaller round opening through the center of the round opening in the face; said smaller round opening configured to open to the back of the club head for accepting a threaded post there-through;

a threaded post attached to the round shaft member and arranged to extend through both the hole in the center of the thin round member and the smaller round opening;

a nut removably attached to the threaded post from the back of the club head to secure the round shaft member and thin round member to the club head;

an adjustable fastening arrangement that makes use of the face of the round shaft member that opposes the thin round member, a substantial portion of the face of the thin round member that opposes the round shaft member, the face of the thin round member that opposes the face of the club head, and the round opening in the face of the club head;

said adjustable fastening arrangement including a combination of half-spherical divots on the surface of the round opening in the face of the club head and half-spherical protrusions on the face of the thin round member that opposes the round opening in the face of the club head;

said adjustable fastening arrangement arranged such that a combination of said half-spherical divots and said half-spherical protrusions mate the thin round member to the round opening in the face of the club head, in any of a number of positions;

said adjustable fastening arrangement including a combination of a half-spherical protrusion on the surface of the round shaft member that opposes the face of the club head and half-spherical divots on the face of the thin round member that opposes the round shaft member;

said adjustable fastening arrangement arranged such that a combination of said half-spherical protrusion and said half-spherical divots mate the round shaft member to the face of the thin round member that opposes the round shaft member, in any of a number of positions;

the half-spherical divots are arranged in a substantially circular path adjacent the perimeter of either the thin round member or the surface of the round opening in the face of the club head, and cover a substantial portion of the perimeter.

* * * * *